US005514420A

United States Patent [19]

Tsuzuki et al.

[11] Patent Number: 5,514,420

[45] Date of Patent: May 7, 1996

[54] METHOD OF PAINTING ELONGATED WORKPIECE

[75] Inventors: Masayo Tsuzuki; Hidenobu Nishida, both of Sayama, Japan

[73] Assignee: Honda Giken Kogyo Kabushiki Kaisha, Tokyo, Japan

[21] Appl. No.: 294,024

[22] Filed: Aug. 24, 1994

[30] Foreign Application Priority Data

| | | | |
|---|---|---|---|
| Sep. 8, 1993 | [JP] | Japan | 5-223506 |
| Sep. 8, 1993 | [JP] | Japan | 5-223507 |
| Nov. 5, 1993 | [JP] | Japan | 5-276977 |

[51] Int. Cl.[6] ..... B05D 7/00

[52] U.S. Cl. ..... 427/421; 118/313; 118/316; 118/323; 118/DIG. 11; 239/532; 239/548; 239/567

[58] Field of Search ..... 427/421; 118/313, 118/316, 323, DIG. 11; 239/532, 548, 567

[56] References Cited

U.S. PATENT DOCUMENTS 3,857,511 12/1974 Govindan ..... 239/11

4,076,175 2/1978 Bert ..... 239/532

FOREIGN PATENT DOCUMENTS 0456523 11/1991 European Pat. Off. .

*Primary Examiner*—Shrive Beck
*Assistant Examiner*—David M. Maiorana
*Attorney, Agent, or Firm*—Armstrong, Westerman, Hattori, McLeland & Naughton

[57] ABSTRACT

A painting gun having a ring-like gun main body with a circumferential opening formed in one peripheral portion thereof so as to allow for passage of an elongated workpiece as an object to be painted, and a plurality of nozzles radially disposed so as to eject a paint towards a central portion of the gun main body. The painting gun is moved in a longitudinal direction of the elongated workpiece after the elongated workpiece is placed in position inside the painting gun through the circumferential opening. Each of the nozzles atomizes the paint by atomizing air. An amount of the paint to be ejected from each of the nozzles is set to 35 cc/min or less, preferably 20 cc/min or less, per 1 kg/cm$^2$ of an atomizing air pressure.

4 Claims, 11 Drawing Sheets

METHOD OF PAINTING ELONGATED WORKPIECE

BACKGROUND OF THE INVENTION

1. Field of the Invention

The present invention relates to a method of painting an elongated workpiece mainly having a complicated cross-sectional shape such as a door sash of an automobile.

2. Description of Related Art

There have hitherto been known methods of painting elongated workpieces, as disclosed in Japanese Published Unexamined Utility Model Registration Application No. 69580/1988 and in Japanese Published Unexamined Utility Model Registration Application No. 123555/1991. In the above-described methods there are used painting guns, each of which is made up of a ring-like gun main body having an opening or slit in one circumferential portion or a circumferentially discontinued portion (hereinafter called a circumferential opening) through which the elongated workpiece as an object to be painted can pass, and a plurality of nozzles which are radially disposed on the gun main body to eject a paint towards the central portion of the gun main body. The elongated workpiece is painted by moving the painting gun in the longitudinal direction of the elongated workpiece in a condition in which the elongated workpiece is placed in position inside the painting gun by passing it through the circumferential opening.

In the above-described conventional methods of painting, a uniform painting can be made if the elongated workpiece has a simple cross-sectional shape such as a circle. However, in painting a workpiece of a complicated cross-sectional shape such as a door sash of an automobile, there is a disadvantage in that the amount of paint reaching the inside of a recess such as a groove formed on the surface of the workpiece is insufficient, giving rise to a so-called phenomenon of lack of hiding. If, on the other hand, an amount of the paint to be ejected is increased in an attempt to cause the paint to reach the inside of the recess, another disadvantage may occur in that an excessive amount of paint is adhered to other portions of the workpiece, giving rise to a so-called phenomenon of sagging or run.

As another method of painting an elongated workpiece having a complicated cross-sectional shape, there is known the following method as disclosed, for example, in Japanese Published Unexamined Patent Application No. 180768/1987. Namely, there is provided a painting booth which is filled therein with an atomized paint. The paint is thus caused to be uniformly adhered or painted to the entire surface, inclusive of a recess, of an elongated workpiece by passing the workpiece through the painting booth. However, in the case of the door sash of the automobile as described above, the distance or clearance between the sash and the automobile body is relatively small. Therefore, it is impossible to provide a painting booth of a size large enough to enclose the door sash. It follows that this kind of painting method using the painting booth cannot be applied.

In view of the above disadvantages, the present invention has an object of providing a method of painting an elongated workpiece having a complicated cross-sectional shape in which method the workpiece can be uniformly painted by a ring-type painting gun without using a painting booth.

SUMMARY OF THE INVENTION

In order to attain the above and other objects, the present invention includes a method of painting an elongated workpiece using a painting gun comprising a ring-like gun main body having a circumferential opening formed in one peripheral portion thereof so as to allow for passage therethrough of the elongated workpiece as an object to be painted, and a plurality of nozzles radially disposed so as to eject a paint towards a central portion of the gun main body, the method being carried out by moving the painting gun in a longitudinal direction of the elongated workpiece in a condition in which the elongated workpiece is placed in position inside the painting gun through the circumferential opening. Each of the nozzles is constituted by an air atomizing nozzle for atomizing the paint by atomizing air, and an amount of paint to be ejected from each of the nozzles is set to 35 cc/min or less, preferably 20 cc/min or less, per1 kg/cm$^2$ of an atomizing air pressure.

As a nozzle for painting, aside from an air atomizing nozzle, there is an airless nozzle in which a paint to be ejected out of minute holes without using air is atomized under the influence of a shear operation at the time of ejection. Since the size of the particles to be generated by the airless nozzle is relatively large in diameter, they have a strong tendency to proceed or travel straight ahead. Therefore, it is difficult to cause the paint to adhere to an inside of a recess. On the other hand, the air atomizing nozzle can produce paint particles each having a relatively small diameter and, since these minute paint particles are blown towards the workpiece on the air, the paint particles more easily reach the inside of the recess. The painting gun as disclosed in the above-described Japanese Published Unexamined Utility Model Registration Application No. 123555/1991 is also the air atomizing nozzle. An ordinary air atomizing nozzle is designed to eject a paint of the order of 100 cc/min per 1 kg/cm$^2$ of the atomizing air pressure and therefore irregularities of the painting finish cannot completely be removed. On the other hand, according to the present invention, the amount of the paint to be ejected is limited to 35 cc/min or less as described above. Therefore, the ratio of air to the paint increases and the air or air streams to be ejected out of each nozzle interfere with each other in the neighborhood of the workpiece, giving rise to irregular flows. The paint is dispersed by these irregular flows, so that the paint can be uniformly adhered to the surface of the workpiece.

Depending on a portion of the elongated workpiece, there are cases where only part of the surface of the workpiece is painted. In such a case, the ejection of the paint from a nozzle or nozzles facing the portion not to be painted must be stopped. However, if the operation of part of the nozzles is stopped, the paint that is ejected from the other nozzles sometimes adhere to those portions which are not to be painted by the paint's going around or detouring into those portions. In this case, if the ejection of the atomizing air is continued even when the ejection of the paint from any of the nozzles is stopped depending on the portion of the elongated workpiece, the atomizing air is kept blowing towards those portions of the surface of the workpiece which face the nozzle or nozzles the paint ejection from which has been stopped. As a result, even if the paint from the other nozzles tries to go around into those portions not to be painted, it is blown back by the atomizing air, and the paint will not therefore be adhered to those portions requiring no painting. In addition, even if the ejection of the paint from a part of the nozzles is stopped, the ejecting conditions of the etomizing air of the painting gun as a whole will not be changed. Therefore, the direction of blowing of the paint from the other nozzles will not vary, and there will be no disadvantage in that the paint is inadvertently splashed to those portions outside the workpiece.

By the way, if the amount of the paint to be ejected from the nozzle is constant, there can be fixed, as a relative speed of the nozzle against the elongated workpiece, a minimum speed below which a sagging may occur and a maximum speed above which a lack of hiding may occur. When there is a bent portion in a midst of the elongated workpiece, and the painting gun must be moved by turning along the bent portion in painting the bent portion, if the relative speed of the nozzle or nozzles which are located inside the bent portion becomes smaller than the minimum speed, the travelling speed of the painting gun may be increased within a range in which the relative speed of the nozzle or nozzles located on the outer side of the bent portion does not exceed the maximum speed. However, if the radius of curvature of the bent portion becomes smaller than a predetermined value, there will occur a condition in which the relative speed of the nozzle or nozzles on the inner side becomes smaller than the minimum speed and, at the same time, the relative speed of the nozzle or nozzles on the outer side becomes larger than the maximum speed. Then, there will occur a sagging on the inner side and the lack of hiding on the outer side.

In this case, preferably the painting gun is moved while maintaining a moving direction thereof along a first tangential line of the elongated workpiece at a front end of the bent portion and, after once removing the painting gun out of engagement with the elongated workpiece by allowing the elongated workpiece to pass through the circumferential opening, a central portion of the painting gun is made to coincide with a second tangential line of the elongated workpiece at a rear end of the bent portion, and thereafter the painting gun is moved along the second tangential line so as to allow the elongated workpiece to be positioned through the circumferential opening inside the painting gun to continue the painting of the elongated workpiece. Then, first the front half of the bent portion and then the rear half of the bent portion can be painted in a condition in which the relative speed of any of the nozzles is kept within a range of the minimum speed and the maximum speed. The occurrence of the sagging on the inside of the bent portion and the lack of hiding on the outer side can be prevented.

Further, it is preferable to incline the direction of ejecting the paint from each of the nozzles towards an axial direction of the painting gun at a predetermined angle relative to a radial direction of the painting gun. According to this arrangement, the air containing the paint becomes easier to flow into the groove-like recessed portion of the elongated workpiece. As compared with the method of painting by blowing the paint at right angles to the surface of the workpiece, it become possible to uniformly apply the paint. In addition, even if the diameter of the painting gun is made smaller, the paint from a nozzle will not reach that portion of the painting gun which is opposite the portion in which the nozzle is disposed. Consequently, the painting gun itself is not stained. Therefore, painting of a narrow portion can also be made by miniaturizing the painting gun.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
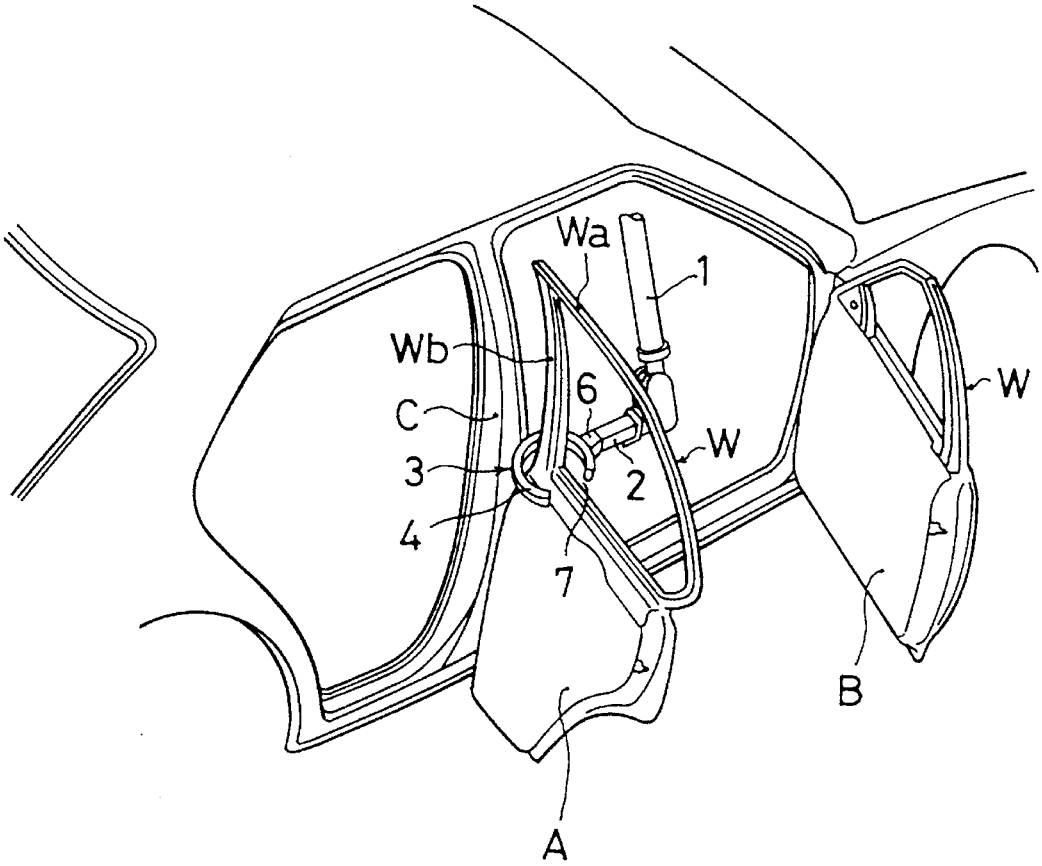
FIG. 1 is a perspective view showing a painting step of that door sash of an automobile which is an elongated workpiece.

FIG. 1 shows a painting step of a door sash W of a rear door A or a front door B of an automobile. The painting of the door sash W is carried out with a painting gun 3 that is mounted on a wrist portion 2 at the front end of a robot arm 1.

Figure 2:
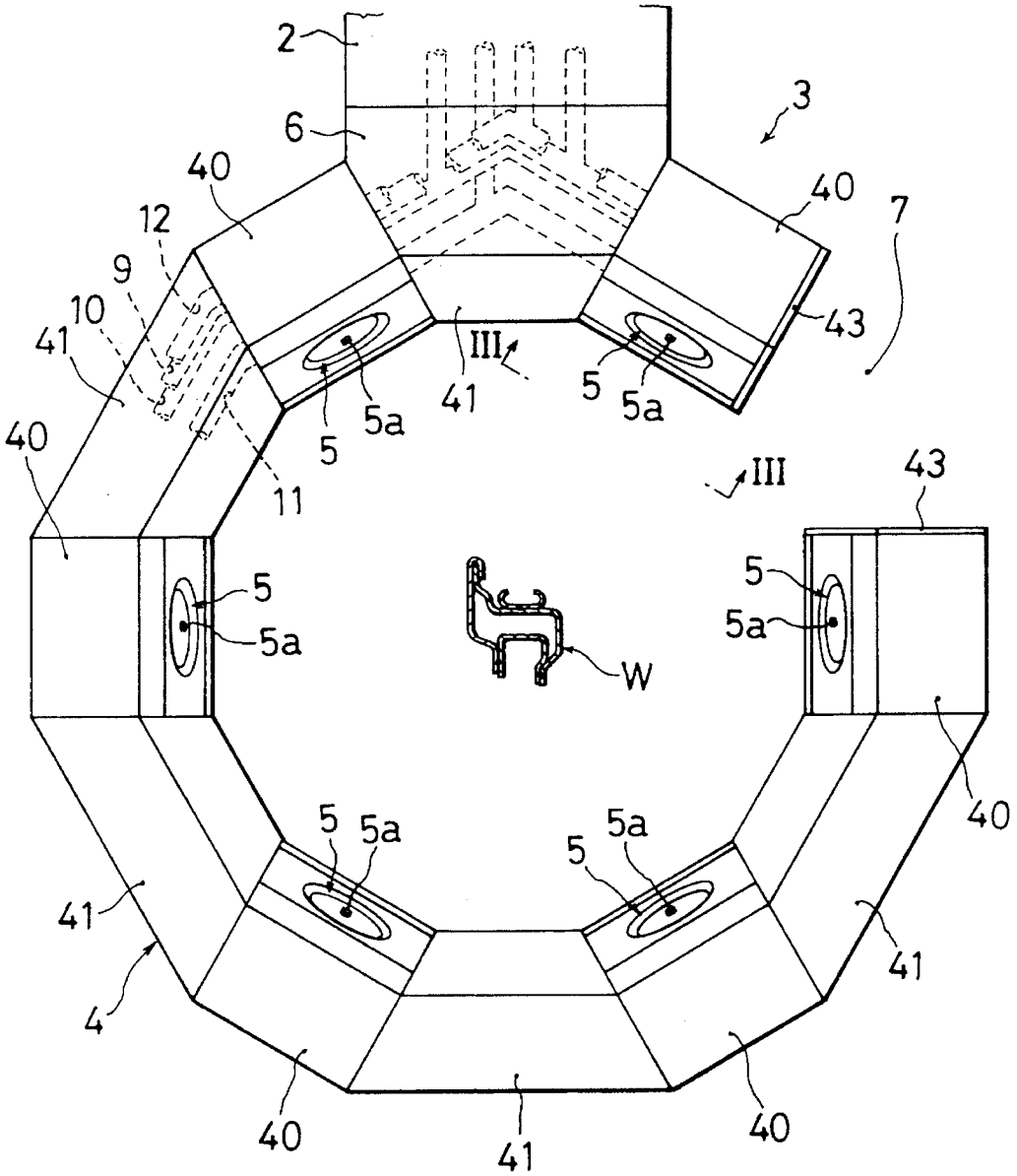
FIG. 2 is a front view of an example of a ring-type painting gun to be used in the present invention.

The painting gun 3 is made up, as shown in FIG. 2, of a ring-like gun main body 4 and a plurality of (six in the illustrated example) nozzles 5 which are radially disposed to eject a paint towards the central portion of the gun main body 4. The painting gun 3 is mounted on the above-described wrist portion 2 at a mounting base portion 6 which is provided in a circumferentially one side of the gun main body 4. A circumferential opening 7 is formed in a portion near the mounting base portion 6 of the gun main body 4. Painting of the door sash W is carried out, in a condition in which the door sash W is placed in position inside the painting gun 3 by passing it through the circumferential opening 7, by moving the painting gun 3 in the longitudinal direction of the door sash W.

The gun main body 4 is made up by connecting by means of bolts 42 nozzle blocks 40 each having mounted thereon a nozzle 5 and manifold blocks 41 alternately in the circumferential direction. In one portion of the circumferential direction of the gun main body 4, there is provided a portion where the manifold block 41 is not mounted, thereby forming the above-described circumferential opening 7. In addition, one manifold block 41 is extended diametrically outwards to form the above-described mounting base portion 6.

Figure 3:
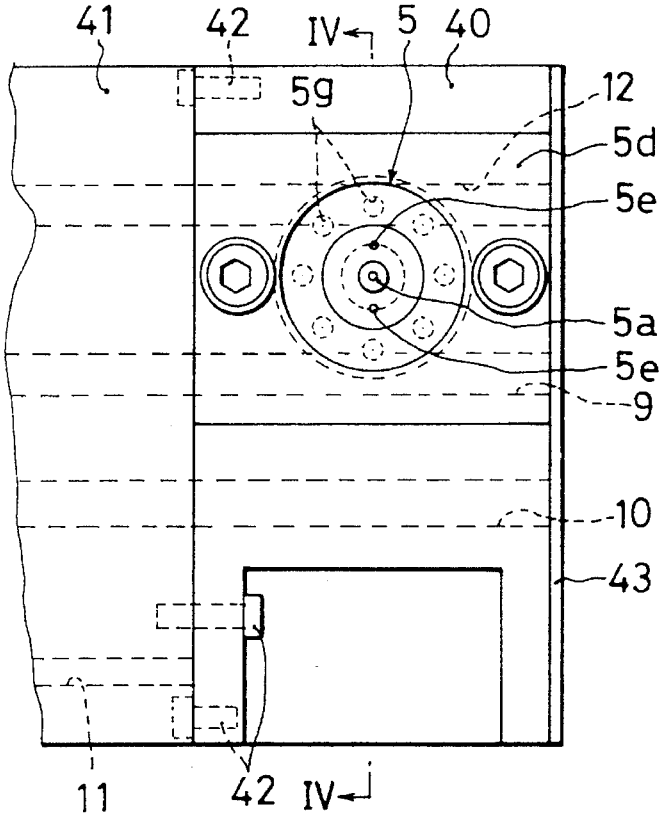
FIG. 3 is a view as viewed from the line III—III in FIG. 2.
Figure 4:
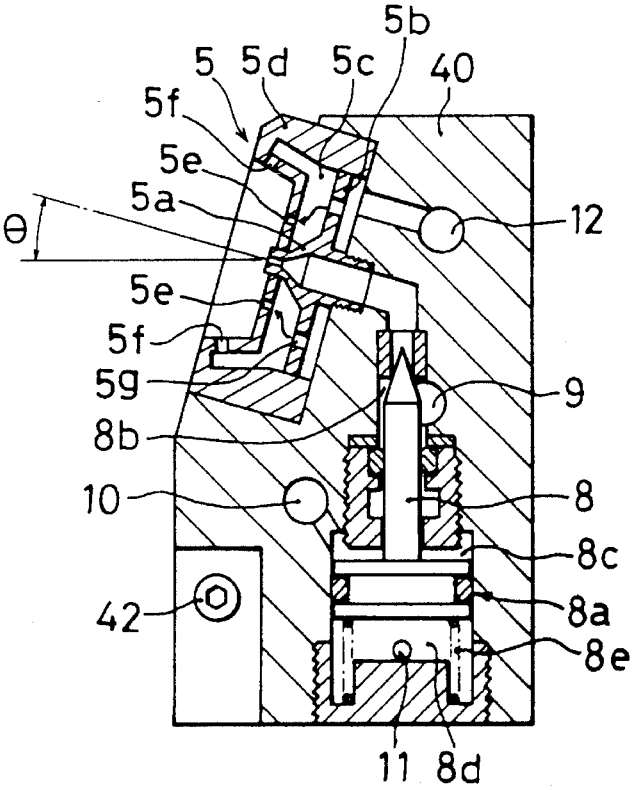
FIG. 4 is a sectional view taken along the line IV—IV in FIG. 3.

Each of the nozzles 5 is made up of an air atomizing nozzle which operates to atomize the ejected paint by blowing air therethrough, their details being explained with reference to FIGS. 3 and 4. The nozzle 5 is made up of a nozzle main body **5*a* which ejects the paint and a nozzle cover 5*d* which defines an air chamber 5*c* between the nozzle cover 5*d* and a flange 5*b* which is formed on a rear outer periphery of the nozzle main body 5*a*. The paint is supplied to the nozzle main body 5***a* via a needle type gate valve 8 which is provided inside the nozzle block 40 and which is opened and closed by a cylinder 8*a*. On the other hand, air is ejected from the air chamber 5*c* through atomizing nozzle holes 5*e* which are formed in the nozzle cover 5*d*. The paint to be ejected from the nozzle main body 5*a* is thus atomized by the atomizing air to be ejected from the atomizing nozzle holes 5*e*. The paint thus atomized is ejected towards a circular area. Therefore, in order for the paint to be ejected to an area of a desired shape, air is also ejected from patterning nozzle holes 5*f* which are formed in the nozzle cover 5*d*. The ejecting pattern of the paint is thus adjusted so that the paint can be ejected to a desired area, e.g., an oblong area.

In each of the nozzle blocks 40 there are traversely formed, a paint passage (a passage for the paint) 9, an air supply passage 10 and air discharge passage 11 for the cylinder 8*a*, and an atomizing air passage 12. The paint passage 9 communicates with a valve chamber 8*b* of the gate valve 8, and the air supply passage 10 and the air discharge passage 11 are brought into communication respectively with a front chamber 8*c* and a rear chamber 8*d* of the cylinder 8*a*. It is thus so arranged that, when air pressure is inputted to the front chamber 8*c* of the cylinder 8*a* via the air supply passage 10, the gate valve 8 is opened against a spring 8*e* inside the rear chamber 8*d*, whereby the paint is supplied from the valve chamber 8*b* to the nozzle main body 5*a*. The atomizing air passage 12 is in communication with a rear side space of the nozzle 5. Therefore, the atomizing air is supplied to the air chamber 5*c* via connecting holes 5*g* formed in the flange 5*b*. The above-described passages 9, 10, 11, 12 in one nozzle block 40 is communicate with respective corresponding passages in the adjacent blocks 40 via the manifold blocks 41 in between the nozzle blocks 40, and are further connected to passages on the side of the robot via the mounting base portion 6. A cover plate 43 is attached to each end surface of the nozzle blocks 40 which are positioned on each of the circumferential opening 7, thereby closing the above-described passages 9, 10, 11, 12.

Each of the nozzles 5 is slantingly mounted inwards on each nozzle block 40 so that the direction of ejection of the paint becomes inclined towards the axial direction at a predetermined angle of θ relative to the radial direction of the painting gun 3. According to this arrangement, there are the following advantages. Namely, the air containing the paint becomes easily flowable inside the groove-like recesses of the door sash W, whereby a more uniform painting can be carried out. In addition, since the painting gun 3 itself is less likely to get stained with the paint, the painting gun can be miniaturized so that the painting of a narrow portion can also be carried out.

Figure 5:
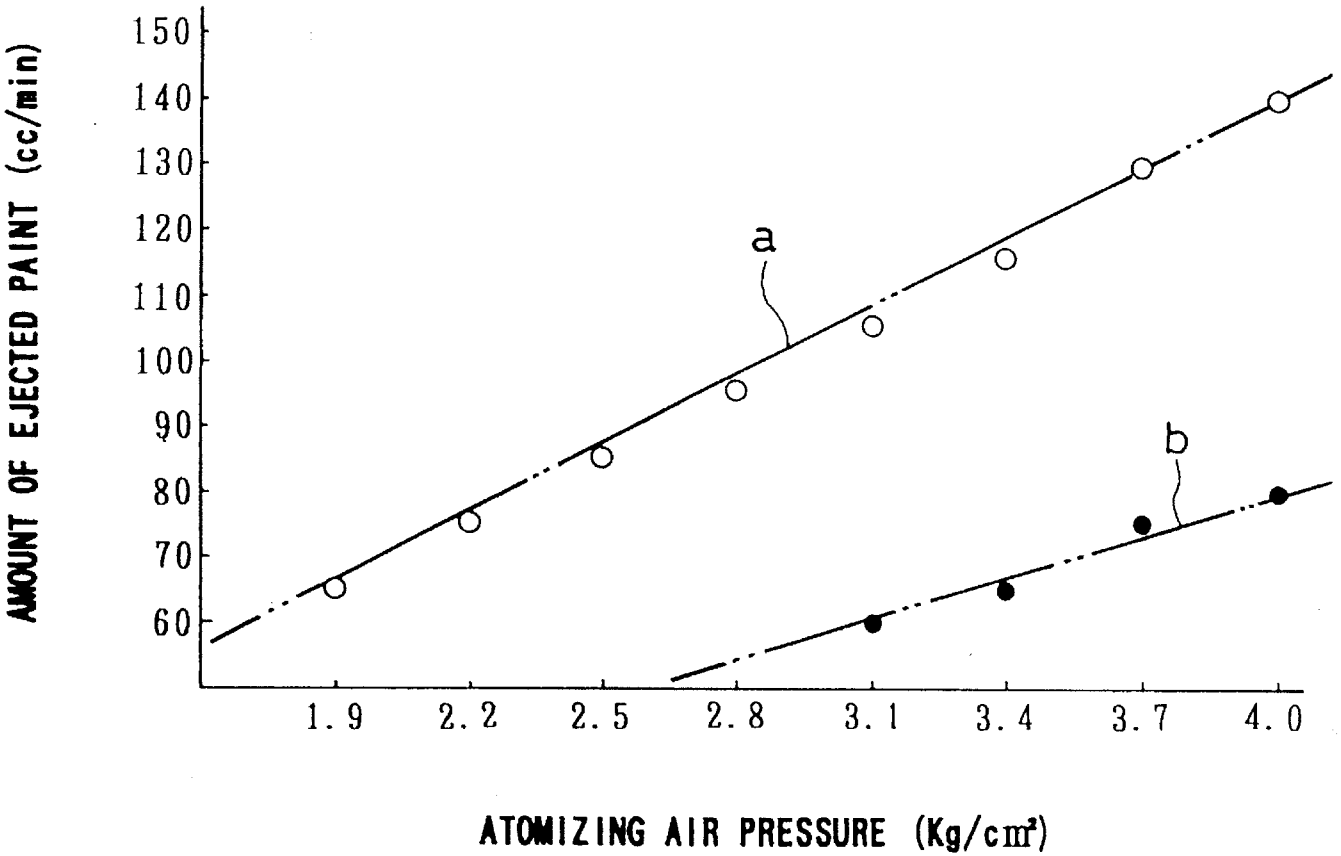
FIG. 5 is a graph showing an upper limit value of an amount of paint to be ejected relative to an atomizing air pressure.

The result of painting the door sash W using the painting gun 3 of the above-described construction is shown in FIG. 5. It has been confirmed that the smaller the amount of paint to be ejected, the better the painting condition when the atomizing air pressure is constant. The reason for this phenomenon is considered to be as follows. Namely, since the absolute amount of paint to be ejected is small, there will occur no sagging. Further, since the paint mists (i.e., atomized paints) get well agitated due to the mutual interference of the air to be ejected from the respective nozzles, there will occur no lack of hiding. In this Figure, the abscissa represents an atomizing air pressure and the ordinate represents an amount of paint to be ejected from each nozzle 5. The door sash was painted by varying the amount of paint to be ejected for every atomizing air pressure and the results were visually judged. Those upper limits of the amount of paint to be ejected below which the painted products become good or acceptable are marked with white circles and, further, those upper limits of the amount of paint to be ejected below which the products become extremely good are marked with black circles. By the way, a two-dot chain line "a" in this Figure shows a condition in which the amount of paint to be ejected is 35 cc/min per1 kg/cm$^2$ of atomizing air pressure. As can be seen from this Figure, the following has been confirmed. Namely, if the amount of paint to be ejected is kept below 35 cc/min per 1 kg/cm$^2$ of atomizing air pressure, good products can be obtained. Preferably, if the amount of paint to be ejected is kept below 20 cc/min per 1 kg/cm$^2$ of atomizing air pressure as shown by a two-dot chain line "b", still better products can be obtained.

If the travelling speed of the painting gun is slowed down, the amount of paint to be ejected can further be decreased. However, if the amount of paint to be ejected becomes excessively small, pulsation occurs to the ejection of the paint, with the result that the paint can no longer be ejected in a stable manner. Therefore, it is preferable to set the amount of paint to be ejected to a minimum of 5 cc/min per 1 kg/cm$_2$ of atomizing air pressure.

Figure 6:
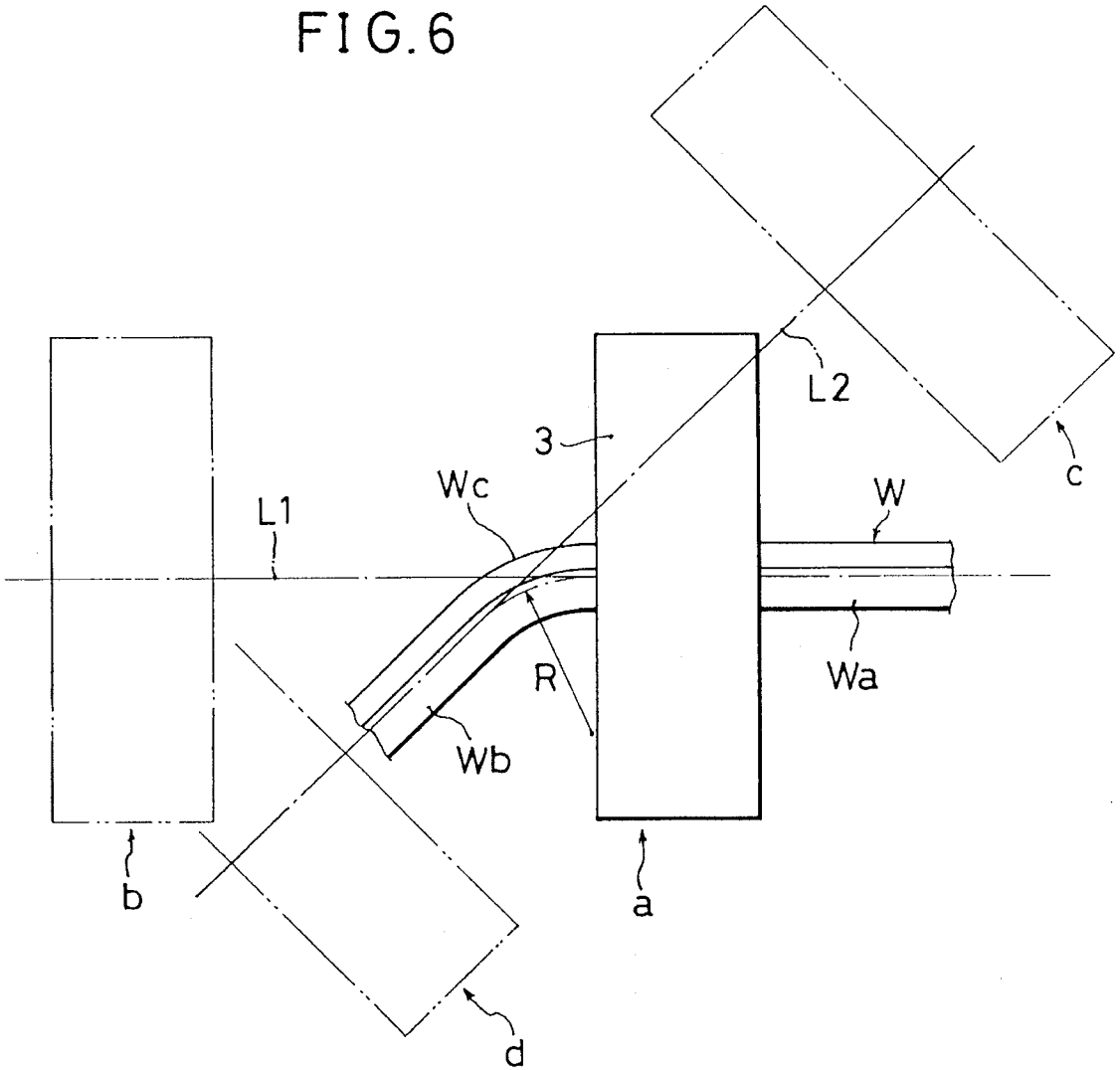
FIG. 6 is a diagram showing the path of movement of the painting gun at a bent portion of the workpiece.

By the way, as shown in FIG. 6, the door sash W has a bent portion Wc between a horizontal sash portion Wa and a vertical sash portion Wb. When the painting gun 3 is moved by turning from the horizontal sash portion Wa to the vertical sash portion Wb along the bent portion Wc, there may sometimes occur poor painting such as sagging on an inner side of the bent portion Wc and lack of hiding on an outer side thereof.

When the amount of paint to be ejected from each nozzle 5 is set to 35 cc/min per 1 kg/cm$^2$ of atomizing air pressure, the lowest speed, i.e., a limit speed above which no sagging occurs has been confirmed to be 300 mm/sec and the highest speed, i.e., a limit speed below which no lack of hiding occurs has ben confirmed to be 600 mm/sec in the actual painting work. Here, if the distance or clearance between the door sash W and the nozzle 5 is set to be 75 mm, the relative speed Vi of the nozzle to paint the inside of the bent portion Wc must meet the following condition in order to prevent the occurrence of sagging, $$Vi>300\ R/(R-75) \quad (1)$$

where R is a radius of curvature of the bent portion Wc.

On the other hand, the relative speed Vo of the nozzle to paint the outer side of the bent portion Wc must meet the following condition in order to prevent the occurrence of lack of hiding, $$Vo<600\ R/(R+75) \quad (2)$$

Figure 7:
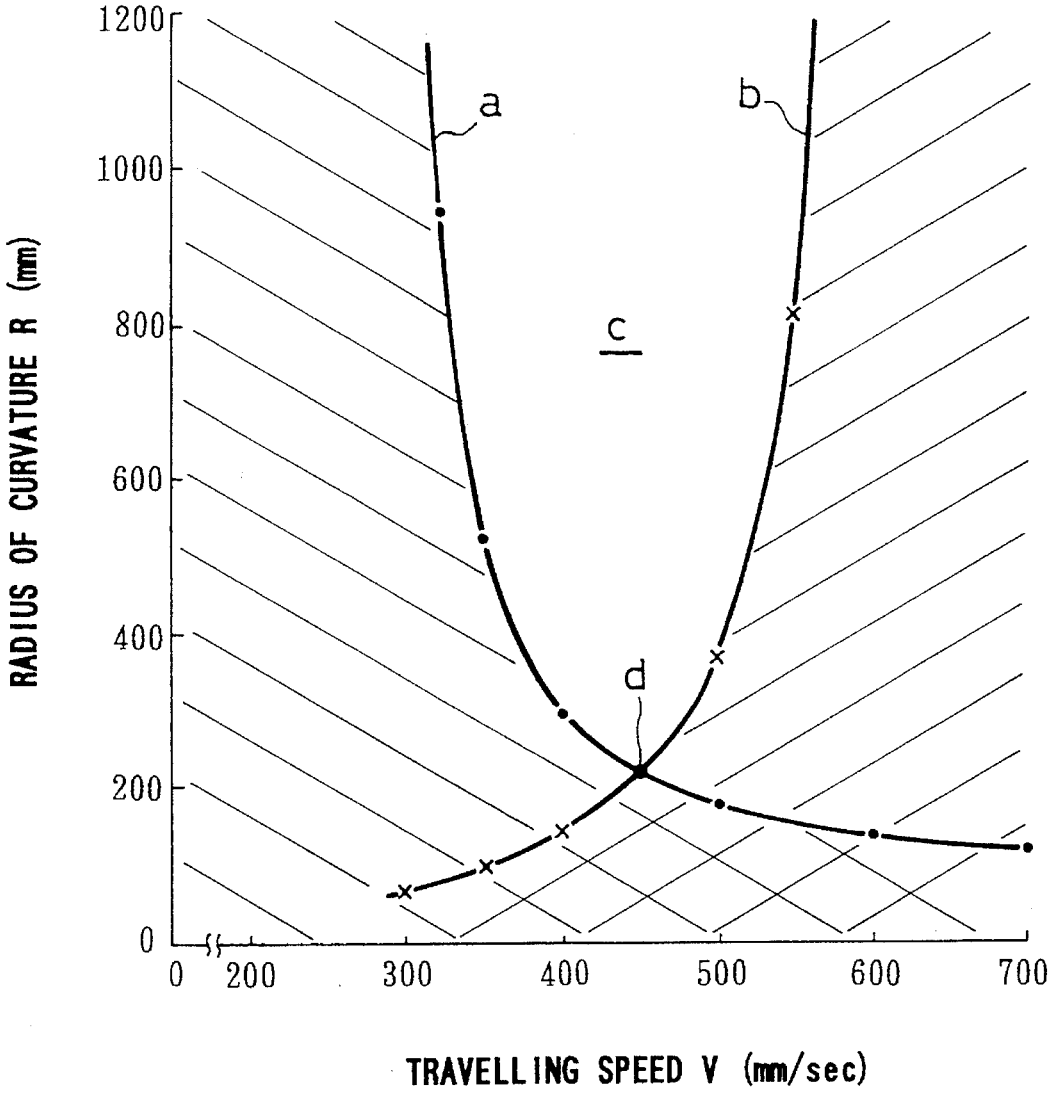
FIG. 7 is a graph showing the relationship between the travelling speed of the painting gun and the radius of curvature of a bent portion required to prevent poor painting.
Figure 8:
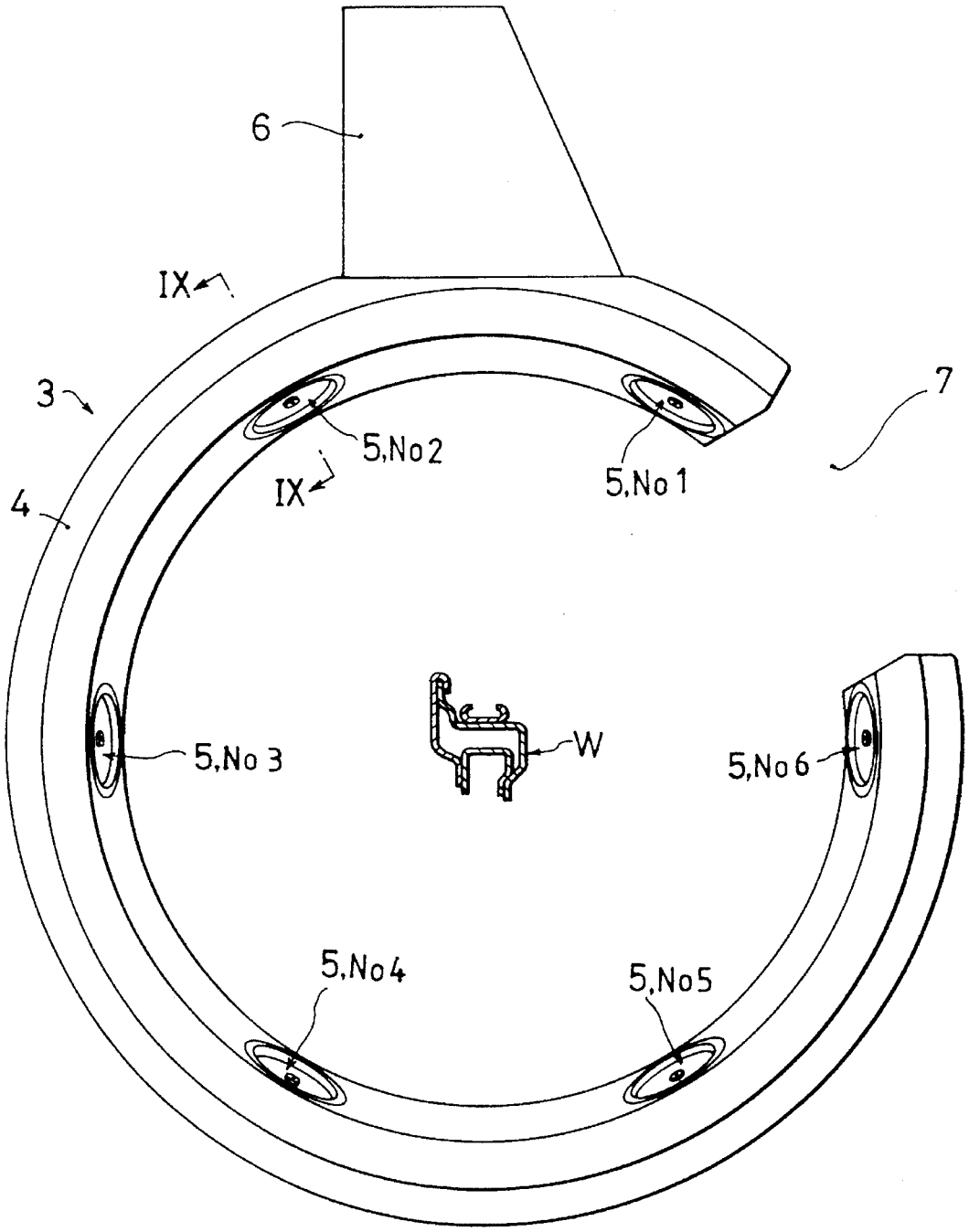
FIG. 8 is a front view of a ring-type painting gun of another embodying example.

The area to meet the above formula (1) lies on the right-hand side area of a curve "a" in FIG. 7 and the area to meet the above formula (2) lies on the left-hand side area of a curve "b" in the same Figure. In this Figure, the abscissa represents the travelling speed V of the central portion of the painting gun 3 and the ordinate represents the radius of curvature R of the bent portion Wc. In the painting conditions inside the area c which falls between the curve "a" and the curve "b", there will occur neither sagging nor lack of hiding even if a continuous painting were to be carried out while moving the painting gun 3 by turning it at the bent portion Wc. The crossing point "d" of the curve "a" and the curve "b" shows critical conditions for carrying out a continuous painting, the conditions being R=225 mm and V=450 mm/sec. Therefore, when the radius of curvature at the bent portion Wc is smaller than 225 mm, sagging and lack of hiding do occur to whatever travelling speed the painting gun 3 may be adjusted.

In such a case, the occurrence of sagging and lack of hiding is prevented by moving the painting gun 3 sequentially to positions a, b, c, d as shown in FIG. 6. In other words, when the painting gun 3 has reached an entrance or a front end of the bent portion Wc by moving it along the horizontal sash portion Wa, the painting gun 3 is kept on moving from position "a" to position "b" along a tangential line L1 of the entrance to the bent portion Wc. The painting gun 3 is thus made to pass in its circumferential opening 7 over the vertical sash portion Wb to thereby once remove the painting gun 3 out of engagement with the door sash W. Then, after moving the painting gun 3 by changing its posture to a position "c" at which the central portion thereof corresponds to a tangential line L2 of an exit or a rear end of the bent portion Wc, the painting gun 3 is moved to a position "d" along the tangential line L2. The painting gun 3 is thus made to pass in its circumferential opening 7 over the horizontal sash portion Wa to thereby bring the vertical sash portion Wb to a position inside the painting gun 3 (or into engagement with the painting gun 3). According to this operation, at the time of movement of the painting gun 3 from the position "a" to the position "b", half part on the side of the horizontal sash portion Wa is painted, and half part on the side of the vertical sash portion Wb is painted at the time of movement of the painting gun 3 from position "c" to position "d". In addition, the relative speed of any nozzle 5 falls between the above-described upper limit speed and the lower limit speed. Consequently, good painting of the bent portion Wc can be carried out without the occurrence of poor painting such as sagging and lack of hiding.

By the way, in painting the door sash W of the rear door A as shown in FIG. 1, it is necessary to once remove the painting gun 3 out of engagement at the corner portion of the vertical sash portion Wb and the horizontal sash portion Wa to thereafter transfer it along the horizontal sash portion Wa. In this case, if the circumferential opening 7 is formed diametrically opposite the mounting base portion 6, it becomes necessary to once move round or detour the mounting base portion 6, relative to the vertical sash portion Wb, in a direction opposite to that in which the horizontal sash portion Wa extends in order to make the circumferential opening 7 coincide with the horizontal sash portion Wa. However, since there exists in this position a center pillar C of the automobile, the wrist portion 2 of the robot interferes with the center pillar C. On the contrary, if the circumferential opening 7 is formed in a position close to the mounting base portion 6, the circumferential opening 7 can be made to coincide with the horizontal sash portion Wa without moving round or detouring the mounting base portion 6 towards the side of the center pillar C. The painting gun 3 can thus be removed upwards of the door sash W without giving rise to the interference of the wrist portion 2 with the center pillar C.

In the above-described embodiment, the gun main body 4 is made up by circumferentially connecting the nozzle blocks 40 and the manifold blocks 41 together. The gun main body 4 may however be made up by connecting a plurality of ring-like blocks in an axial direction. Explanation of this kind of painting gun 3 will hereinafter be made with reference to FIGS. 8 through 12.

Figure 9:
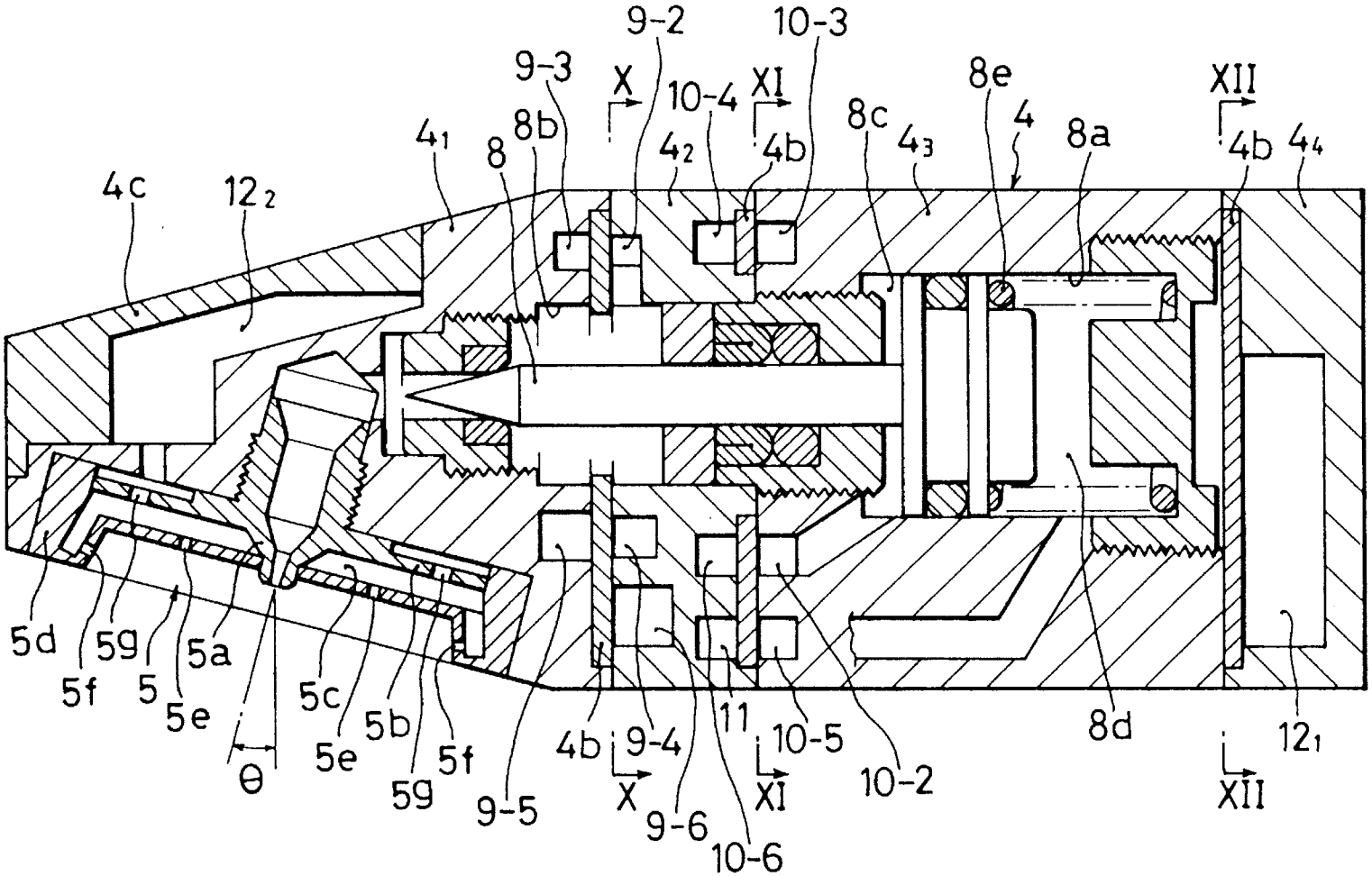
FIG. 9 is a sectional view taken along the line IX—IX in FIG. 8.
Figure 10:
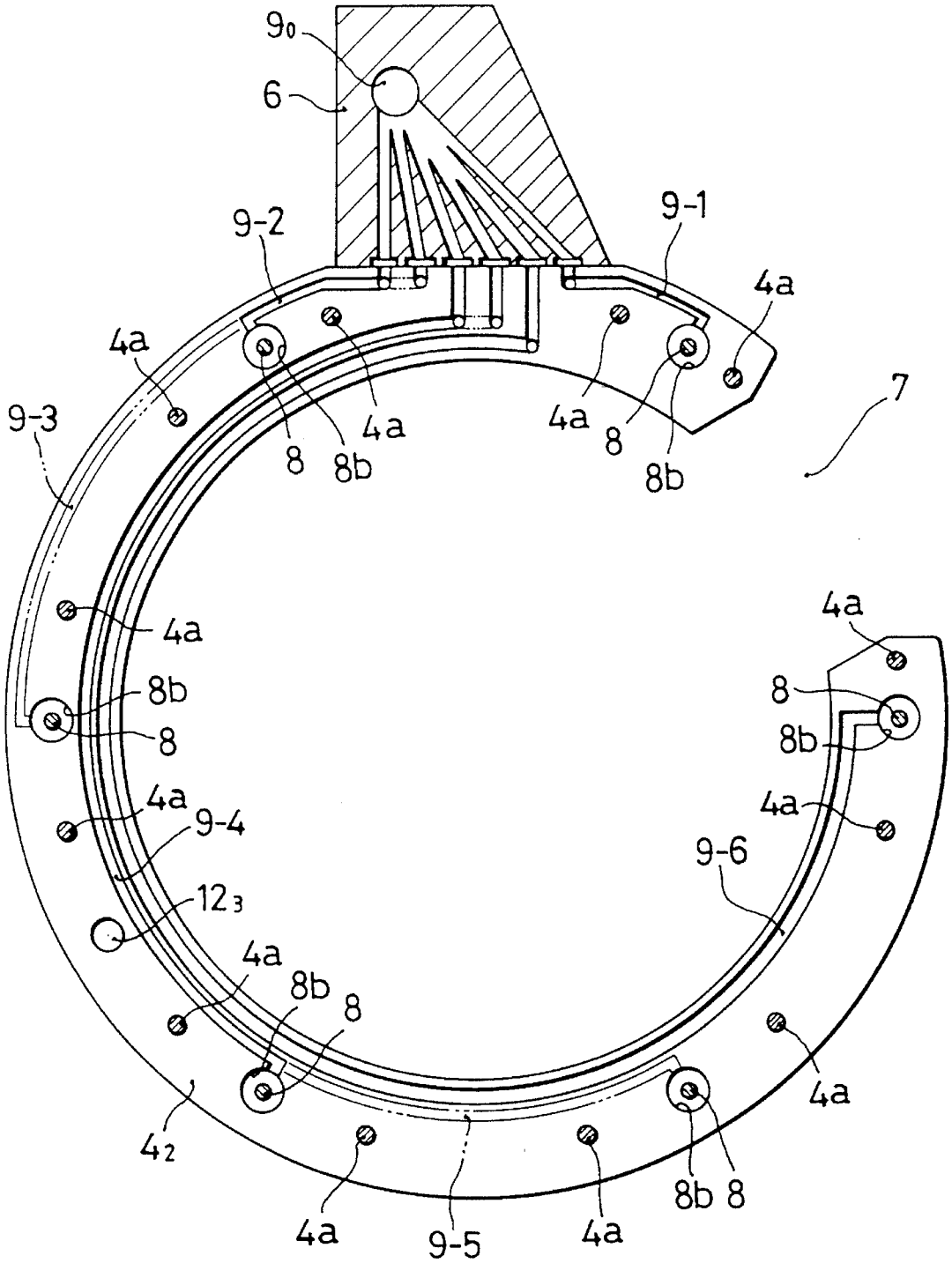
FIG. 10 is a sectional view taken along the line X—X in FIG. 9.
Figure 11:
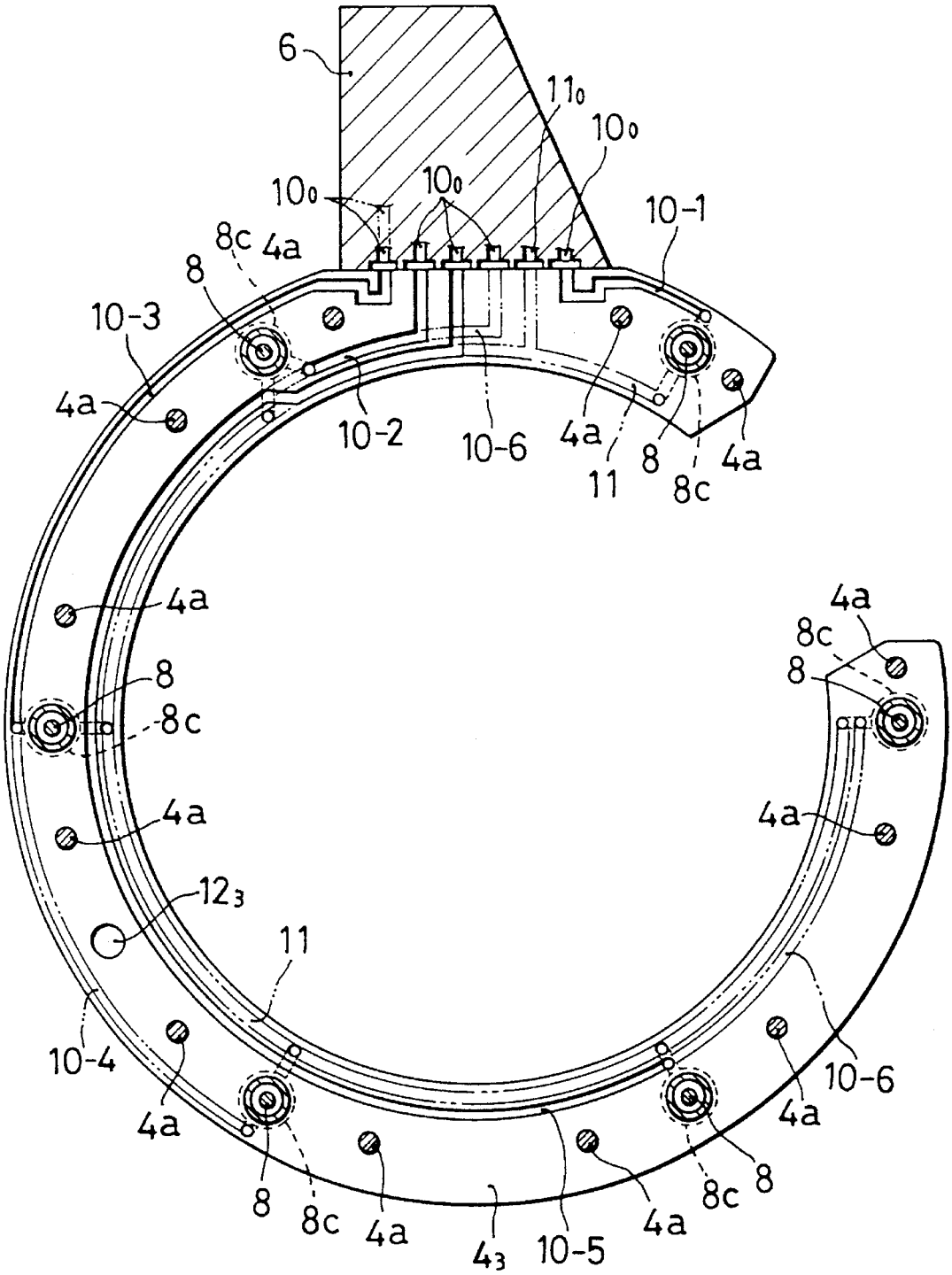
FIG. 11 is a sectional view taken along the line XI—XI in FIG. 9.

In this embodiment, the gun main body 4 is made up, as shown in FIG. 9, by connecting, in the axial direction, four pieces of first through fourth ring-like blocks $4_1$, $4_2$, $4_3$, $4_4$. The first through the third blocks $4_1$, $4_2$, $4_3$ are fastened together by bolts 4*a* as shown in FIGS. 10 and 1, the fourth block $4_4$ being fastened by machine screws 4d shown in FIG. 12 to the third block $4_3$. Air atomizing nozzles 5 are attached to an internal peripheral portion of the first block $4_1$. A valve chamber 8*b* of a gate valve 8 is formed so as to extend between the first block $4_1$ and the second block $4_2$. A cylinder 8*a* is formed in the third block $4_3$.

A plurality of grooves are formed by mold forming on a connecting surface of the first block $4_1$ connecting it to the second block $4_2$ and on a connecting surface of the second block $4_2$ connecting it to the first block $4_1$. By these grooves there are formed a plurality of paint passages (i.e., passages for paint to flow through) 9 to supply each of the nozzles 5 with the paint. The arrangement of the above-described paint passages will now be explained with reference to FIG. 10. The nozzles are numbered as No. 1 through No. 6 in the order starting from that end of the circumferential opening 7 which is closer to the mounting base portion 6 towards the opposite end thereof. On the connecting surface of the second block $4_2$ connecting it to the first block $4_1$ there are formed paint passages 9-1, 9-2, 9-4 and 9-6 which are respectively in communication with the valve chambers 8*b* of the gate valves 8 for No. 1, No. 2, No. 4 and No. 6 nozzles 5. On the connecting surface of the first block $4_1$ connecting it to the second block $4_2$ there are formed paint passages 9-3 and 9-5 which are respectively in communication with the valve chambers 8*b* of the gate valves 8 for No. 3 and No. 5 nozzles 5. These paint passages 9 are combined into one for connection to a common paint passage $9_0$ which is formed in the mounting base portion 6. The paint passages 9-3, 9-5 on the side of the first block $4_1$ and those 9-1, 9-2, 9-4 on the side of the second block $4_2$ are partitioned or separated from each other by a packing 4*b* which is disposed between the first and the second blocks $4_1$, $4_2$. Further, depending on the length of the paint passages 9 which are disposed between both the blocks $4_1$, $4_2$, the cross-sectional areas thereof are varied. Namely, the cross-sectional areas of the shorter paint passages 9-1 and 9-2 are made smaller, and those of the passages 9-3, 9-4, 9-5 and 9-6 are made gradually larger in the order mentioned so that the flow resistance of each of the paint passages 9-1 through 9-6 becomes equal to each other. According to this arrangement, the paint can be equally ejected from each of No. 1 through No. 6 nozzles 5. The door sash W can therefore be painted uniformly over the entire circumference thereof without giving rise to irregularities in finish.

By the way, depending on a portion to be painted, it is preferable to selectively eject the paint from each of the nozzles 5. Therefore, it becomes necessary to independently control to open or close the gate valve 8 for each of the nozzles 5. As a solution, a plurality of air supply passages 10 are formed on the connecting surface between the second block 42 and the third block 43 so that the air can be supplied independently to the cylinder 8*a* of each of the gate valves 8. An explanation will now be made in more detail with reference to FIG. 11. On the connecting surface of the third block 43 connecting it to the second block 42 there are formed air supply passages 10 (10-1, 10-2, 10-3 and 10-5) which are respectively in communication with the front chambers 8*c* of the cylinders 8 for opening and closing the gate valves 8*a* of No. 1, No. 2, No. 3 and No. 5 nozzles 5. In addition, on the connecting surface of the second block 42 connecting it to the third block 43 there are formed air supply passages 10 (10-4, 10-6) which are respectively in communication with the front chambers 8*c* of the cylinders 8*a* for opening and closing the gate valves for No. 4 and No. 6 nozzles 5, as well an air discharge passage 11 which is in communication with the rear chambers 8*d* of the cylinders 8*a* for opening and closing the gate valves for No. 1 through No. 6 nozzles 5. These air supply passages 10 are connected to an unillustrated respective control valves via separate air supply passages $\mathbf{10}_0$ which are formed in the mounting base portion 6 so that the gate valve 8 of each nozzle 5 can be separately controlled by each of the control valves. The air discharge passage 11 is opened to atmosphere via an exhaust port $\mathbf{11}_0$ which is formed in the mounting base portion 6. The air supply passages 10 and the air discharge passage 11 on the side of the second block $\mathbf{4}_2$ and the air supply passages 10 on the side of the third block $\mathbf{4}_3$ are separated by a packing 4*b* which is disposed between the second and the third blocks $\mathbf{4}_2$, $\mathbf{4}_3$.

Figure 12:
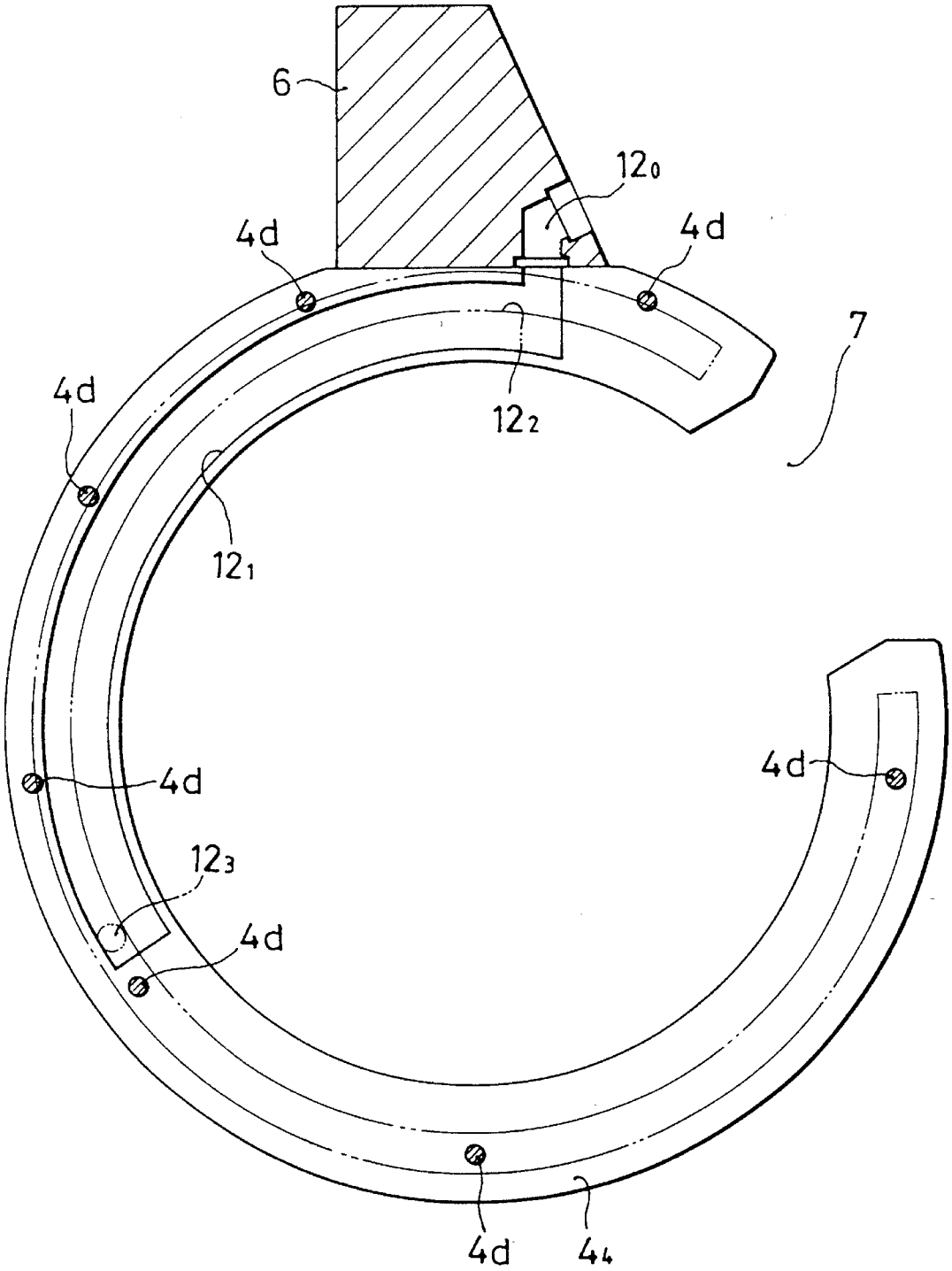
FIG. 12 is a sectional view taken along the line XII—XII in FIG. 9.

On the connecting surface of the fourth block $\mathbf{4}_4$ connecting it to the third block $\mathbf{4}_3$ there is formed, as shown in FIG. 12, an upstream-side atomizing air passage $\mathbf{12}_1$ which is connected to an atomizing air supply passage $\mathbf{12}_0$ formed in the mounting base portion 6, the air supply passage $\mathbf{12}_1$ being extended up to a portion which lies diametrically opposite to the circumferential opening 7. Further, on an external periphery of the first block $\mathbf{4}_1$ there is mounted a ring-like cover 4*c*. Between the first block $\mathbf{4}_1$ and the cover 4*c* there is formed a downstream-side atomizing air passage $\mathbf{12}_2$ which extends from one end of the circumferential opening 7 to the opposite end thereof. The upstream-side atomizing air passage $\mathbf{12}_1$ is sealed by a packing 4*b* which is disposed between the third block $\mathbf{4}_3$ and the fourth block $\mathbf{4}_4$. The upstream-side atomizing air passage $\mathbf{12}_1$ is connected, at the end portion located opposite to the circumferential opening 7, to the downstream-side atomizing air passage $\mathbf{12}_2$ via an axially extending connecting hole $\mathbf{12}_3$ which passes through the first through the third block $\mathbf{4}_1$, $\mathbf{4}_2$, $\mathbf{4}_3$. In this manner, the downstream-side air passage $\mathbf{12}_2$ is communicated with the rear side space of each of the nozzles 5 so as to supply the atomizing air to the air chamber 5*c* of each nozzle 5 via perforating holes 5*g* formed in the flange 5*b* of each nozzle 5.

According to this arrangement, the atomizing air to be supplied from the side of the mounting base portion 6 is once introduced to the portion that is opposite to the circumferential opening 7, and is then distributed from there to each of the nozzles 5. The atomizing air can thus be supplied substantially evenly to each nozzle 5. In addition, since the atomizing air is constantly supplied to each nozzle 5, atomizing air alone will be kept ejected also from the nozzle or nozzles 5 that have stopped ejection of the paint by closing of the gate valve or valves 8. This atomizing air does effectively function to prevent the paint from the remaining nozzles from entering or detouring into those portions of the object to be painted which face the nozzle or nozzles 5 whose ejection has been stopped and which require no painting. Further, since the atomizing air is constantly ejected from all of the nozzles, even if the ejection of paint from some of the nozzles 5 is stopped, the condition of ejecting the atomizing air from the painting gun 3 as a whole does not change. Therefore, the direction of spraying or splashing of the paint to be ejected out of the other nozzles 5 will not vary and thus an unintended or an inadvertent spraying or splashing of the paint towards the portions other than the object to be painted can be prevented.

It is readily apparent that the above-described method of painting an elongated workpiece meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of painting an elongated workpiece using a painting gun comprising a ring-shaped gun main body having a circumferential opening formed in one peripheral portion thereof so as to allow for passage of the elongated workpiece as an object to be painted, and a plurality of at least three nozzles radially disposed so as to eject a paint towards a central portion of the gun main body, said method comprising the step of:

moving the painting gun in a longitudinal direction of the elongated workpiece in a condition in which the elongated workpiece is placed in position inside the painting gun through the circumferential opening, wherein each of the nozzles consists of an air atomizing nozzle for atomizing the paint by injection of atomizing air, and wherein an amount of the paint to be ejected from each of the nozzles is set to 35 cc/min or less per 1 kg/cm$^2$ of an atomizing air pressure, wherein ejection of the atomizing air is continued even when ejection of the paint from any of the nozzles is stopped depending on a shape of a portion of the elongated workpiece.

2. A method of painting an elongated workpiece using a painting gun comprising a ring-shaped gun main body having a circumferential opening formed in one peripheral portion thereof so as to allow for passage of the elongated workpiece as an object to be painted, and a plurality of at least three nozzles radially disposed so as to object a paint towards a central portion of the gun main body, said method comprising the step of:

moving the painting gun in a longitudinal direction of the elongated workpiece in a condition in which the elongated workpiece is placed in position inside the painting gun through the circumferential opening, wherein each of the nozzles consists of an air atomizing nozzle for atomizing the paint by injection of atomizing air, and wherein an amount of the paint to be ejected from each of the nozzles is set to 35 cc/min or less per 1 kg/cm$^2$ of an atomizing air pressure, wherein the painting gun is moved while maintaining a moving direction thereof along a first tangential line of the elongated workpiece at a front end of the bent portion having a radius of curvature less than a fixed constant value and, after once removing the painting gun out of engagement with the elongated workpiece by allowing the elongated workpiece to pass through the circumferential opening, a central portion of the painting gun is made to coincide with a second tangential line of the elongated workpiece at a rear end of the bent portion, and thereafter the painting gun is moved along the second tangential line so as to allow the elongated workpiece to be positioned through the circumferential opening inside the painting gun to continue the painting of the elongated workpiece.

3. A method of painting an elongated workpiece using a painting gun comprising a ring-shaped gun main body having a circumferential opening formed in one peripheral portion thereof so as to allow for passage of the elongated workpiece as an object to be painted, and a plurality of at least three nozzles radially disposed so as to eject a paint towards a central portion of the gun main body, said method comprising the step of:

moving the painting gun in a longitudinal direction of the elongated workpiece in a condition in which the elongated workpiece is placed in position inside the painting gun through the circumferential opening, wherein each of the nozzles consists of an air atomizing nozzle for atomizing the paint by injection of atomizing air, and wherein an amount of the paint to be ejected from each of the nozzles is set to 35 cc/min or less per 1 $kg/cm^2$ of an atomizing air pressure, and wherein each of the nozzles is inclined toward an axial direction of the painting gun for ejecting the paint at a fixed constant angle relative to a radial direction of the painting gun.

4. A method of painting an elongated workpiece according to claim 2–4, wherein said amount of the paint to be ejected from each of the nozzles is set to 20 cc/min or less.

* * * * *

UNITED STATES PATENT AND TRADEMARK OFFICE

CERTIFICATE OF CORRECTION

PATENT NO.: 5,514,420
DATED : May 7, 1996
INVENTORS: Masayo TSUZUKI et al

It is certified that error appears in the above-identified patent and that said Letters Patent is hereby corrected as shown below:

Column 10, claim 2, line 30, delete "object" and insert therefor --eject--.

Column 12, claim 4, line 2, after "to" change "claim" to --claims--.

Signed and Sealed this

Seventeenth Day of September, 1996

*Attest:*

*Attesting Officer*

BRUCE LEHMAN

*Commissioner of Patents and Trademarks*